US005469993A

United States Patent [19]

Hauf et al.

[11] Patent Number: 5,469,993

[45] Date of Patent: Nov. 28, 1995

[54] DISPENSING SYSTEM

[75] Inventors: Barry W. Hauf, St. Louis, Mo.; Stephen K. Jones, Stratford; Joseph E. Johnson, Jr., Noank, both of Conn.; Roger L. Paquin, Alpharetta, Ga.

[73] Assignee: Monsanto Company, St. Louis, Mo.

[21] Appl. No.: 161,781

[22] Filed: Dec. 2, 1993

[51] Int. Cl.[6] ..... B67D 3/00

[52] U.S. Cl. ..... 222/383.3; 222/530; 222/536

[58] Field of Search ..... 222/383, 484, 222/530, 534, 536, 538

[56] References Cited

U.S. PATENT DOCUMENTS

| | | | |
|---|---|---|---|
| D. 303,087 | 8/1989 | Gendron | D9/378 |
| D. 319,181 | 8/1991 | Balavich | D9/347 |
| D. 325,340 | 4/1992 | Balavich | D9/347 |
| D. 325,341 | 4/1992 | Balavich | D9/347 |
| D. 325,342 | 4/1992 | Balavich | D9/347 |
| 519,534 | 5/1894 | James | 222/534 |
| 1,250,081 | 12/1917 | Bennis . | |
| 1,258,236 | 3/1918 | Menzies . | |
| 1,417,951 | 5/1922 | Staples et al. | 222/534 |
| 1,798,708 | 3/1931 | Smith | 222/530 |
| 1,869,869 | 8/1932 | Smith | 222/383 |
| 1,875,992 | 9/1932 | Clifford | 222/530 X |
| 2,031,672 | 2/1936 | Schaefer | 222/534 |
| 2,516,728 | 7/1950 | Smith | 222/108 |
| 2,648,569 | 8/1953 | Vose | 299/86 |
| 2,793,795 | 5/1957 | Wilson et al. | 222/536 |
| 2,825,333 | 3/1958 | Broman | 128/214 |
| 2,883,091 | 4/1959 | Barravecchia | 222/517 |
| 2,936,934 | 5/1960 | Kubiliunas | 222/484 |
| 2,979,238 | 4/1961 | Bramming | 222/484 |
| 2,986,142 | 5/1961 | Bieberdorf et al. | 128/272 |
| 3,002,699 | 10/1961 | Pinke | 222/383 X |
| 3,026,045 | 3/1962 | Reading | 239/143 |
| 3,089,626 | 5/1963 | Kubiliunas | 222/484 |
| 3,162,194 | 12/1964 | Indelicato | 128/261 |
| 3,163,337 | 12/1964 | Wilson | 222/534 |
| 3,212,677 | 10/1965 | Hronas | 222/81 |
| 3,251,516 | 5/1966 | Thomas | 222/536 |
| 3,283,967 | 11/1966 | Akers | 222/536 |
| 3,430,825 | 3/1969 | Wilson | 222/534 |
| 3,495,745 | 2/1970 | Akers | 222/534 |
| 3,502,248 | 3/1970 | Libit et al. | 222/534 |
| 3,542,256 | 11/1970 | Waterman | 222/484 |
| 3,718,238 | 2/1973 | Hazard et al. | 222/536 |
| 3,780,950 | 12/1973 | Brennan | 239/306 |
| 3,840,153 | 10/1974 | Devlin | 222/146 |
| 3,871,584 | 3/1975 | Wagner | 239/307 |
| 3,884,392 | 5/1975 | Hazard | 222/534 X |
| 3,901,449 | 8/1975 | Bochmann | 239/332 |
| 4,081,113 | 3/1978 | Hazard | 222/534 |
| 4,125,207 | 11/1978 | Ernst et al. | 222/130 |
| 4,192,464 | 3/1980 | Chow | 239/373 |
| 4,243,162 | 1/1981 | Klygis | 222/530 |
| 4,282,991 | 8/1981 | Hazard | 222/531 |
| 4,392,594 | 7/1983 | Swett et al. | 222/530 |
| 4,485,963 | 12/1984 | Panicci | 229/7 |
| 4,519,529 | 5/1985 | Seitz | 222/484 |
| 4,621,770 | 11/1986 | Sayen | 239/304 |

(List continued on next page.)

FOREIGN PATENT DOCUMENTS

| | | |
|---|---|---|
| 0583902A1 | 2/1994 | European Pat. Off. . |
| 93/5738 | 8/1993 | South Africa . |
| 963912 | 7/1964 | United Kingdom . |
| 2269796 | 2/1994 | United Kingdom . |
| WO94/03278 | 2/1994 | WIPO . |

*Primary Examiner*—Andres Kashnikow
*Assistant Examiner*—Lisa Douglas
*Attorney, Agent, or Firm*—Senniger, Powers, Leavitt & Roedel

[57] ABSTRACT

A dispensing system comprising a container for containing a liquid to be dispensed, a sprayer comprising a spray head and a handle, and flexible tubing connectable at one of its ends to the container and connected at its other end to the sprayer for conveying liquid from the container to the sprayer. The container has a recess formed in one of its side walls sized and shaped for receiving the sprayer, and connectors for attaching the sprayer to the container with the sprayer received within the recess. The sprayer is detachable from the container for dispensing liquid from the container.

43 Claims, 8 Drawing Sheets

U.S. PATENT DOCUMENTS

| | | | |
|---|---|---|---|
| 4,732,303 | 3/1988 | Wang | 222/484 |
| 4,767,058 | 8/1988 | LaRosa et al. | 239/309 |
| 4,787,890 | 11/1988 | Ufermann | 604/128 |
| 4,795,094 | 1/1989 | Correard | 239/229 |
| 4,901,878 | 2/1990 | Humphries | 222/530 |
| 4,925,066 | 5/1990 | Rosenbaum | 222/192 |
| 4,950,083 | 8/1990 | Bavaveas | 366/348 |
| 4,972,972 | 11/1990 | Goguen | 222/530 X |
| 5,050,757 | 9/1991 | Hidding et al. | 220/23.83 |
| 5,065,909 | 11/1991 | Pino et al. | 222/484 |
| 5,100,058 | 3/1992 | Wei | 239/273 |
| 5,123,460 | 6/1992 | Reed | 141/95 |
| 5,143,263 | 9/1992 | Newell | 222/538 |
| 5,242,079 | 9/1993 | Stephens et al. | 222/484 X |

DISPENSING SYSTEM

BACKGROUND OF THE INVENTION

This invention relates generally to systems for dispensing liquid and, more particularly, to a dispensing system for dispensing liquid from a container such as a bottle.

Liquid chemicals such as pesticides and herbicides are frequently used in and around homes, lawns and gardens to kill undesirable insects and plants. Typically, the chemicals are provided in a bottle and dispensed therefrom by means of spraying apparatus. Such apparatus often includes a pump-type sprayer, and flexible tubing having a first end within the bottle and a second end connected to the sprayer. The tubing passes through a cap covering an opening at the neck of the bottle. Squeezing an actuator (trigger) of the sprayer draws the liquid chemical from the bottle, through the tubing and out the sprayer. The bottle is typically furnished to the user with the sprayer and tubing contained in a plastic bag hung on the neck of the bottle.

A disadvantage of this arrangement is that the bottle and bag occupy more box space and shelf space than does the bottle itself. Thus, more shipping boxes and more shelf space is required for a given number of bottles and bags than for the same number of bottles. Another disadvantage of the prior bottle/sprayer apparatus arrangement is that after the bag is discarded and the flexible tubing is connected to the bottle, there is no provision to store the bottle with the sprayer fastened to the bottle. During storage between uses, the sprayer and tubing are generally either draped over the bottle or placed on a nearby surface. This often results in undesirable drainage or leakage of liquid from the sprayer and/or tubing and/or bottle onto the surface. Even if the user disconnects and removes the sprayer and tubing from the bottle between uses, undispensed liquid chemicals may seep from the sprayer and tubing. A further disadvantage of the prior bottle/sprayer apparatus arrangement is the difficulty in maintaining the inlet end of the flexible tubing adjacent the bottom of the bottle. The end of the tubing tends to curl upward away from the bottom of the bottle because the tubing tends to assume the curled shape it had in the bag prior to use. Thus, the entire contents of the bottle cannot be dispensed through the sprayer.

SUMMARY OF THE INVENTION

Among the several objects of this invention may be noted the provision of an improved liquid dispensing system; the provision of such a dispensing system having a sprayer, tubing and bottle configured such that the sprayer and tubing are compactly stored with the bottle; the provision of such a dispensing system which minimizes the risk of liquid leaking or draining from the system after use and during storage; the provision of such a dispensing system configured to maintain a tidy appearance; the provision of such a dispensing system in which the sprayer is attachable to the bottle between uses of the dispensing system; the provision of such a dispensing system configured such that essentially all liquid can easily be dispensed from the bottle; the provision of such a dispensing system which is of a simple and durable construction; and the provision of such a dispensing system which is economical to manufacture.

Generally, a dispensing system of the present invention comprises a container for containing a liquid to be dispensed. The container has a top and opposing side walls. The system also includes a sprayer comprising a spray head and a handle connected to the spray head, and flexible tubing having an inlet end adapted to communicate with the interior of the container and an outlet end connectable to the sprayer for conveying liquid from the container to the sprayer. A recess in one of the opposing side walls of the container is sized and shaped for receiving the handle of the sprayer. Means is provided for attaching the sprayer to the container with the sprayer in the recess in a position wherein the spray head of the sprayer is generally adjacent an upper part of the container to minimize leakage of liquid from the container through the sprayer. The sprayer is detachable from the container for dispensing liquid from the container.

In another aspect of the present invention, a dispensing system comprises a sprayer and flexible tubing for conveying liquid in the container to the sprayer. The sprayer has a spray head, a hollow handle connected to the spray head, and an actuator adjacent the handle movably operable to dispense liquid from the spray head. The tubing has an inlet end adapted for connection to the container, an outlet end operatively connected to the spray head, and an intermediate portion between the inlet and outlet ends. The hollow handle is sized and shaped to receive the inlet end and intermediate portion of the flexible tubing for storage thereof in the handle when the inlet end is not connected to the container. The inlet end and intermediate portion are removable from the handle to permit operative connection of the inlet end to the container.

In still another aspect of the present invention, a dispensing system comprises a container for containing a liquid to be dispensed, a closure having a cap and a spout mounted on the cap, a sprayer, and a tubing for conveying liquid from the spout to the sprayer. The cap is adapted for securement to the container and has a cap opening therein for passage therethrough of liquid in the container. The spout has a flow passage therethrough. A generally rigid dip tube is connected to the cap adjacent the opening and is adapted to extend down into the container for conveying liquid in the container to the opening. The tubing has an inlet end and an outlet end. The inlet end is adapted for connection to the spout with the inlet end in communication with the passage in the spout. The outlet end is connected to the sprayer. The spout is mounted on the cap for pivotable movement of the spout relative to the cap between an open position in which the spout flow passage is in registration with the cap opening for passage of liquid in the container out of the container through the dip tube, tubing and sprayer, and a closed position in which the spout flow passage is out of registration with the cap opening and a sealing portion of the spout covers the opening to seal against passage of liquid through the opening.

In still another aspect of the present invention, a dispensing system for dispensing a liquid from a container comprises a closure having a cap and a spout mounted on the cap, a dispensing device comprising a manually operable pump sprayer, and flexible tubing for conveying liquid from the spout to the sprayer. The cap is adapted for securement to the container and has a cap opening therein for passage therethrough of liquid in the container. The spout has a flow passage therethrough. The tubing has an inlet end adapted for connection to the spout with the inlet end in communication with the passage in the spout and an outlet end connected to the sprayer. The flexibility of the tubing permits movement of the sprayer in any direction relative to the container. The spout is mounted on the cap for pivotable movement of the spout relative to the cap between an open position in which the spout flow passage is in registration with the cap opening for passage of liquid in the container out of the container and thence through the tubing to the sprayer, and a closed position in which the spout flow passage is out of registration with the cap opening and a sealing portion of the spout covers the opening to seal against passage of liquid through the opening.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF THE PREFERRED EMBODIMENT

Figure 1:
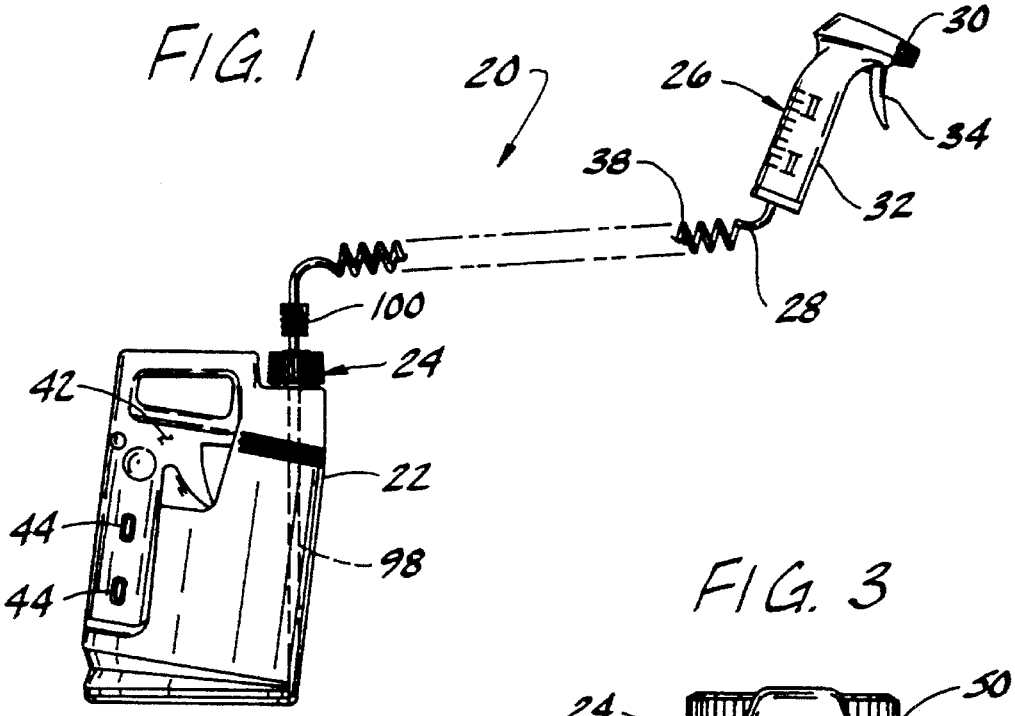
FIG. 1 is a front elevational view of a dispensing system of the present invention comprising a container, a sprayer and tubing.
Figure 2:
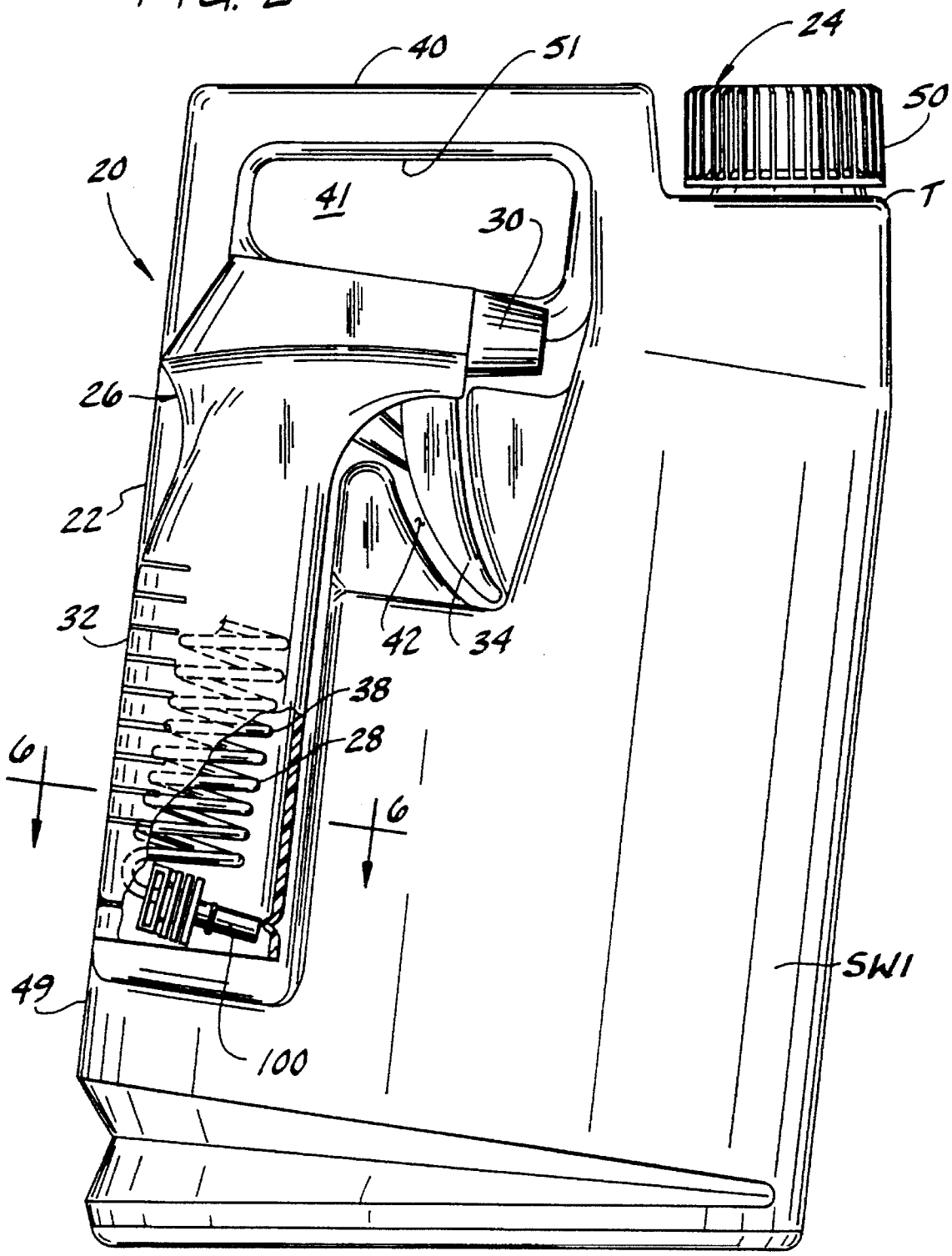
FIG. 2 is an enlarged front elevational view of the dispensing system of FIG. 1 with the sprayer attached to the container and the tubing stored within the sprayer.
Figure 4:
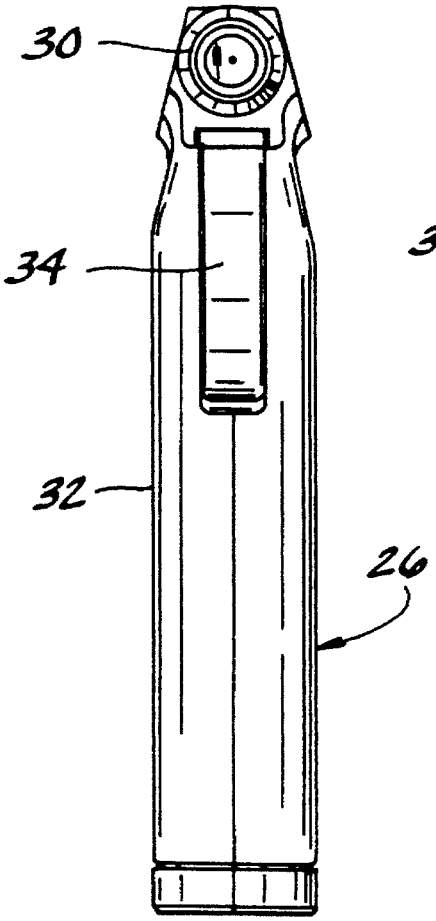
FIG. 4 is a front elevational view of the sprayer of FIG. 1.

Referring now to the drawings, and first more particularly to FIGS. 1 and 2, a dispensing system of the present invention is indicated in its entirety by the reference numeral 20. The dispensing system 20 comprises a container 22 for containing a liquid to be dispensed, such as a herbicide, a closure for the container, generally designated 24, a sprayer, generally designated 26, and flexible tubing 28 connectable at one of its ends to the closure and connected at its other end to the sprayer.

The sprayer 26 comprises a spray head 30, a hollow handle 32 connected to the spray head, and an actuator in the form of a trigger 34 adjacent the handle 32. The tubing 28 is a flexible coiled line having an inlet end 36 (see FIG. 10) adapted for connection to the container 22 via the container closure 24, an outlet end (not shown) operatively connected to the spray head 30, and an intermediate portion 38 between its inlet and outlet ends. As shown in FIG. 2, the hollow handle 32 of the sprayer 26 is sized and shaped to receive the inlet end 36 and intermediate portion 38 of the tubing 28 for storage thereof in the handle when the inlet end is not connected to the container 22. The inlet end 36 and intermediate portion 38 are removable from the handle 32 (see FIG. 1) to permit connection of the inlet end to the container closure 24 prior to operation of the dispensing system 20. The internal valving and working mechanism of the sprayer may be of any suitable conventional design.

Figure 3:
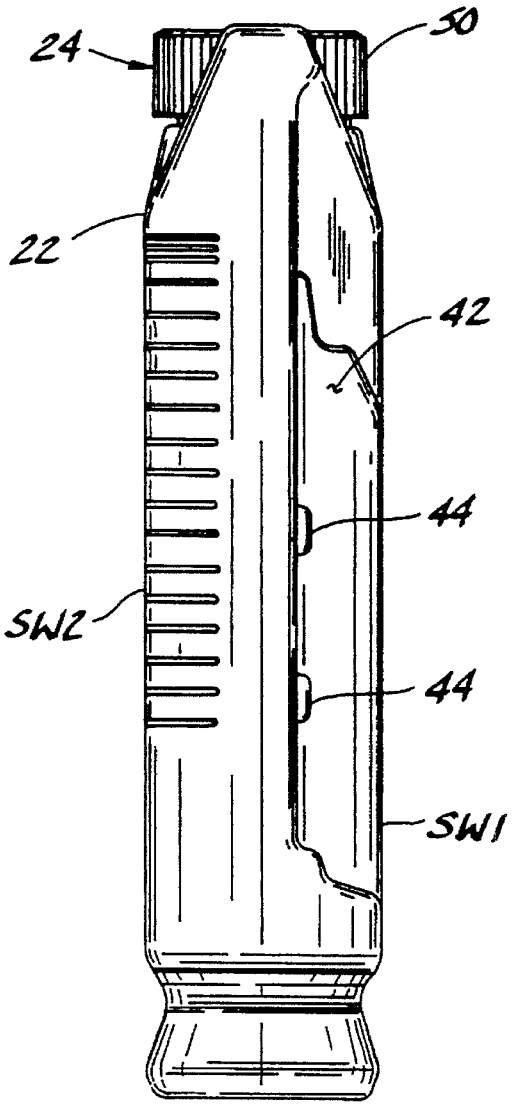
FIG. 3 is a left side elevational view of the container of FIG. 1.
Figure 5:
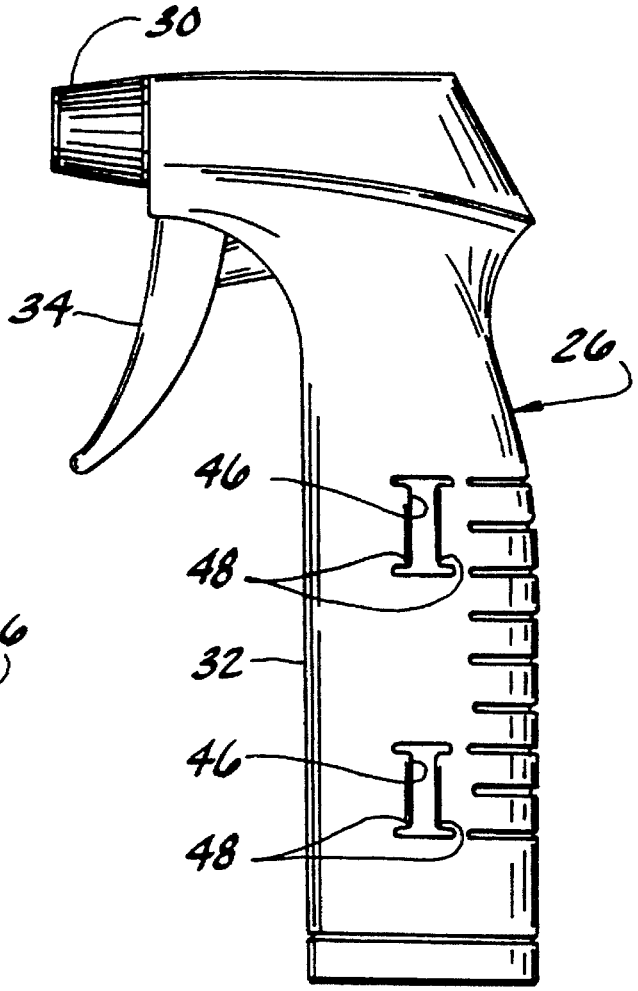
FIG. 5 is a side elevational view of the sprayer of FIG. 4.
Figure 6:
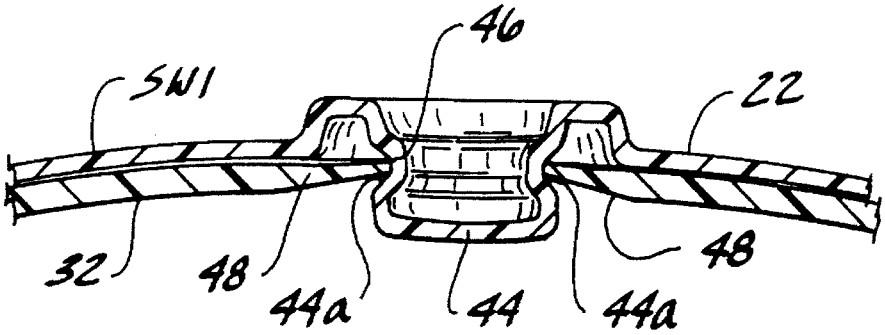
FIG. 6 is an enlarged partial sectional view of the dispensing system of FIG. 2 showing the attachment of the sprayer to the container.
Figure 7:
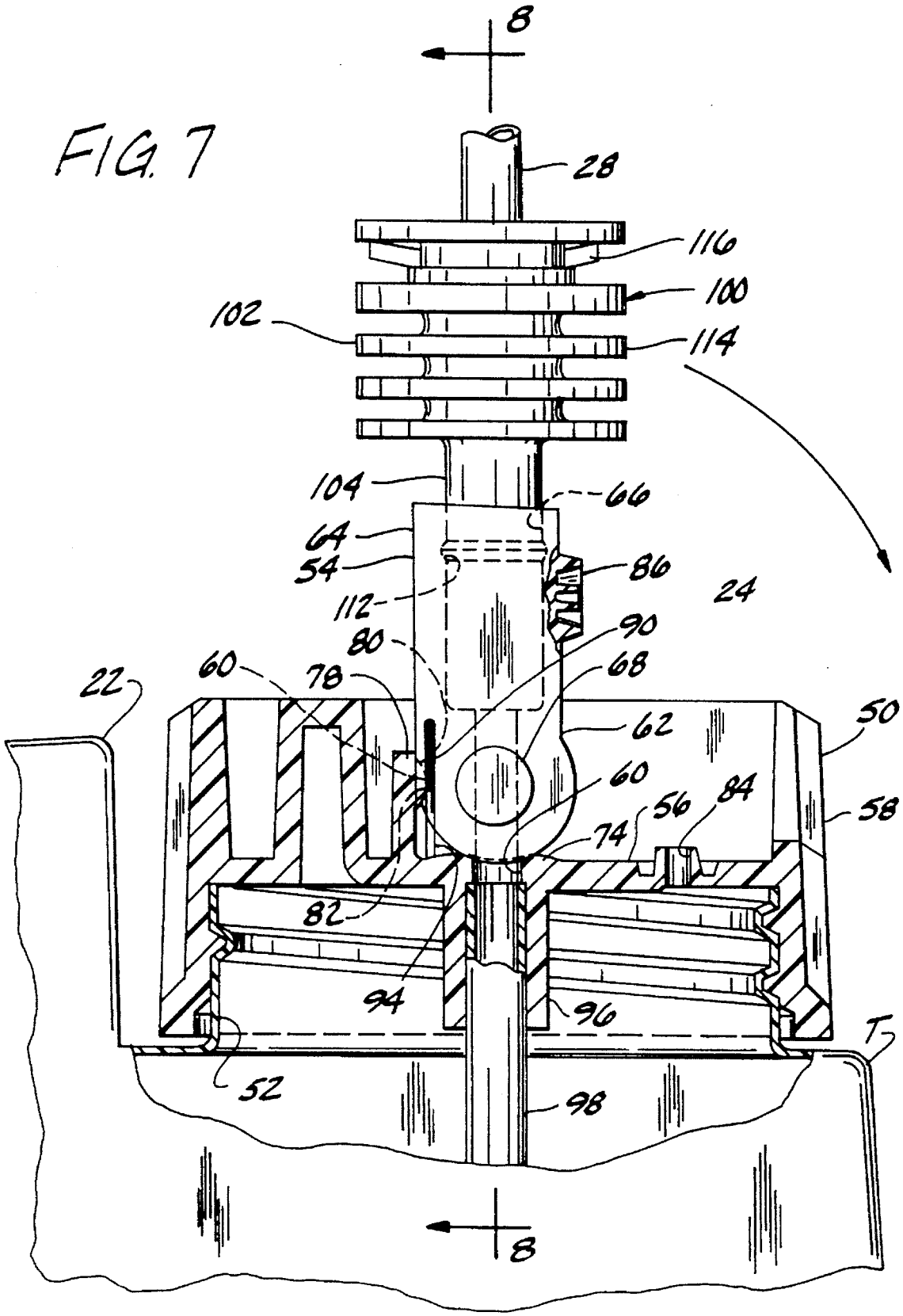
FIG. 7 is an enlarged side elevational view in partial section of a closure for the container of FIG. 1, the closure having a spout shown in an open position.
Figure 8:
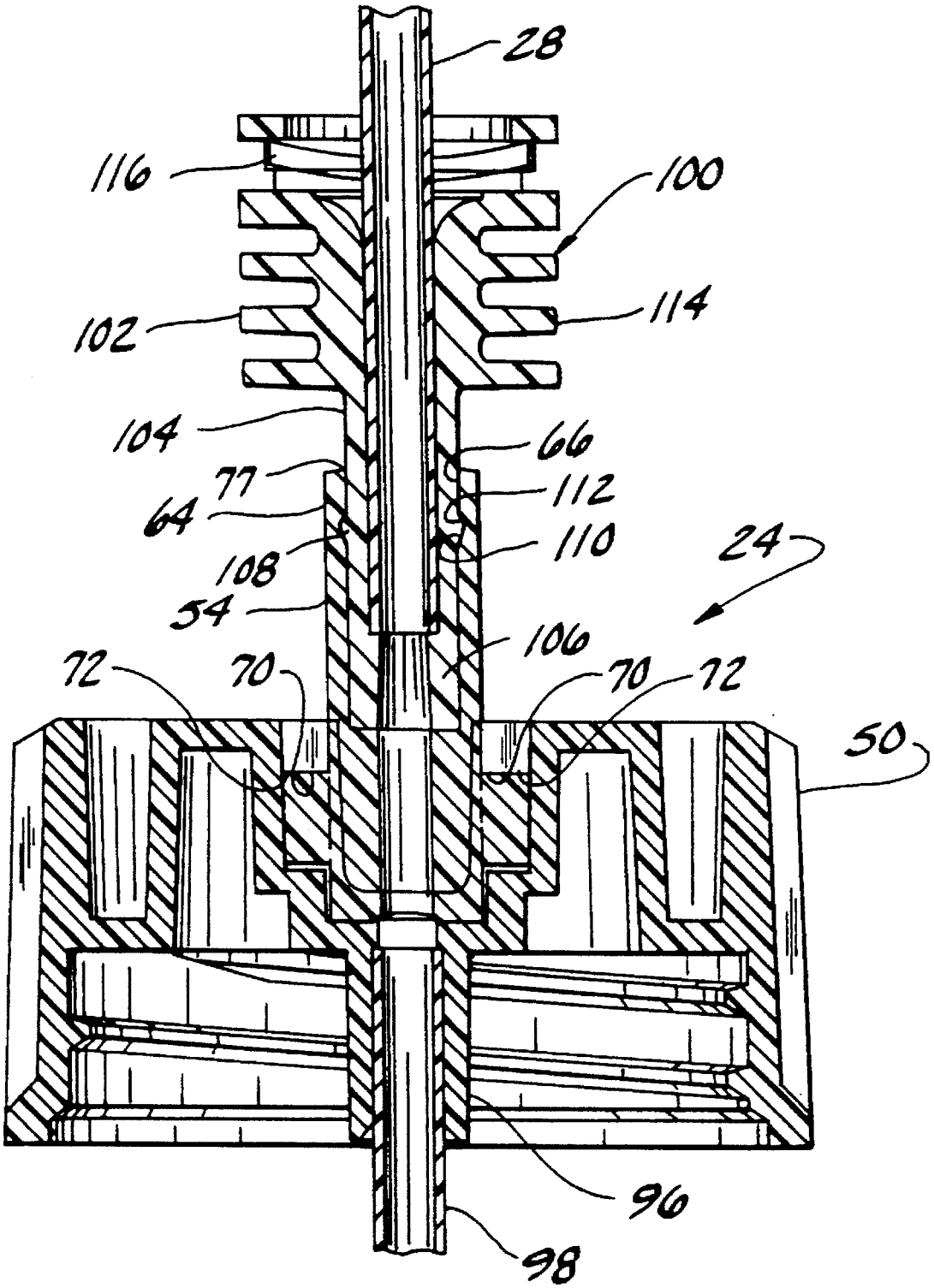
FIG. 8 is a sectional view taken along the plane of line 8—8 of FIG. 7.

The container 22 is made of a polymeric resinous material such as high density polyethylene (HDPE) and is preferably formed by blow molding. As shown in FIGS. 1–3, the container has a top T, opposing side walls SW1, SW2, and a handle 40 at the top of the container defining a handle opening 41. A recess 42 is formed in side wall SW1 of the container 22 and is sized and shaped for receiving the entire sprayer 26, including the handle 32, the trigger 34 and the spray head 30. As shown in FIGS. 1–3, the contour of the recess 42 is substantially similar to the contour of the sprayer 26. The container 22 has two generally rectangular protrusions 44 (see FIGS. 3 and 6) extending laterally outwardly from side wall SW1 in the recess. The hollow handle 32 of the sprayer 26 has two slots 46 (see FIGS. 5 and 6), each defined by a pair of opposing tabs 48. The protrusions 44 are formed as integral parts of the container 22 and the tabs 48 are formed as integral parts of the sprayer 26. As shown in FIG. 6, the protrusions 44 and tabs 48 are sized and shaped for a resilient snap fit of the protrusions 44 into the slots 46 of the handle 32 to a position in which the opposing vertical edges of the tabs are resiliently received in grooves **44*a* along the sides of the protrusions. The tabs 48 and slots 46 constitute female connectors and the protrusions 44 constitute male connectors mateable with the female connectors. When the sprayer 26 is inserted into the recess 42 of the container 22, the container protrusions 44 project through the slots 46 of the handle 32 for engagement by the handle tabs 48 to retain the sprayer in the recess 42. These connectors releasably attach and hold the sprayer 26 against side wall SW1 of the container 22 within the recess 42. Thus, the sprayer 26 is detachable from the container 22 for dispensing liquid from the container and reattachable to the container within the recess 42 for storage of the dispensing system 20**.

Although the male and female connectors have been described as the preferred means for attaching the sprayer 26 to the container 22, it is to be understood that alternative means may be used. For example, the sprayer may be releasably attached to the container by hook and loop type fastening strips (e.g., Velcro® strips) secured to the sprayer and container. Alternatively, the recessed side wall SW1 may be sized and shaped for a snug friction fit of the sprayer within the recess. Although the recess 42 has been described as preferably being formed in side wall SW1 of the container 22, it is to be understood that the recess may alternatively be formed in side wall SW2 of the container.

Preferably the sprayer 26 and recess 42 are sized and shaped so that the outer side of the sprayer is generally flush with the nonrecessed surface of the container 22 when the sprayer is received within the recess. Since the sprayer 26 is flush, the container 22 with the attached sprayer occupies no more shelf space or box space than a container without the sprayer. Thus, the dispensing system 20 can be compactly boxed or stored. It is also significant that, as viewed in FIG. 2, the container, recess 42, sprayer 26 and handle opening 41 are so sized and located relative to one another that when the sprayer is received in the recess, the sprayer is located entirely within the outline 49 of the container and entirely outside the outline 51 of the handle opening 41.

Figure 9:
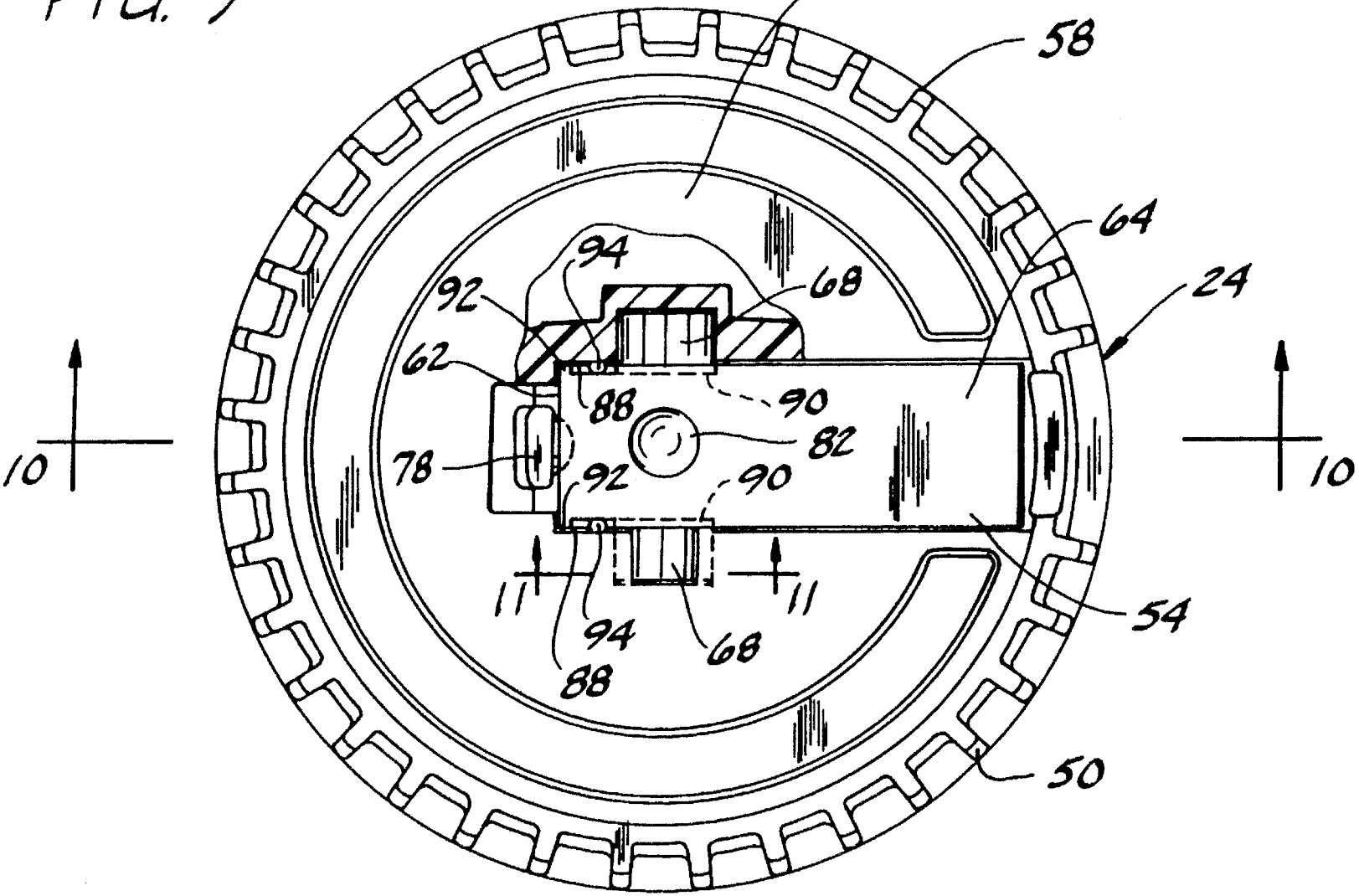
FIG. 9 is a top plan view of the closure of FIG. 7 showing the spout in its closed position and portions broken away to show detail.
Figure 10:
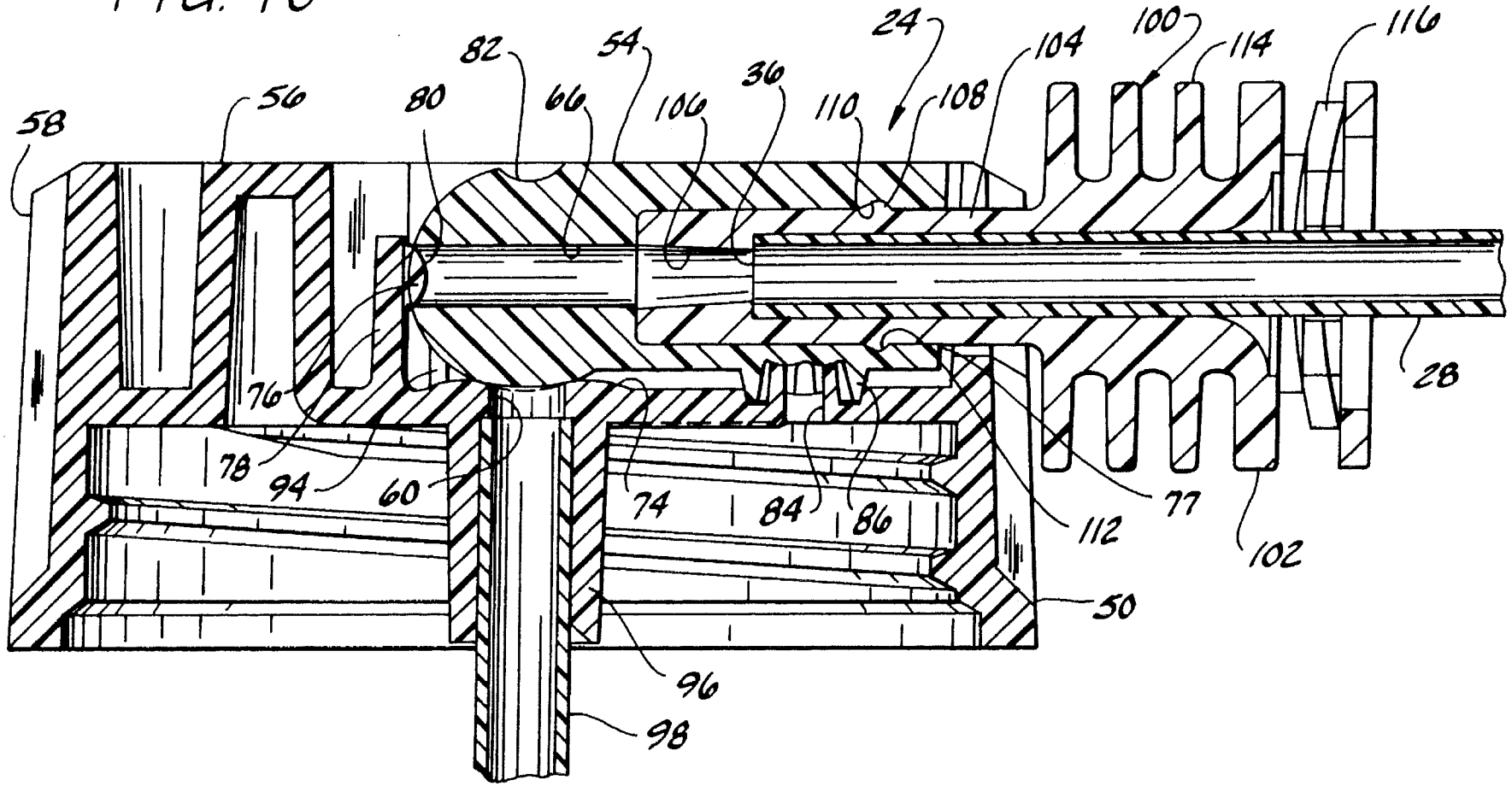
FIG. 10 is a sectional view taken along the plane of line 10—10 of FIG. 9 with a connector, connecting tubing to the spout, inserted into the spout.
Figure 11:
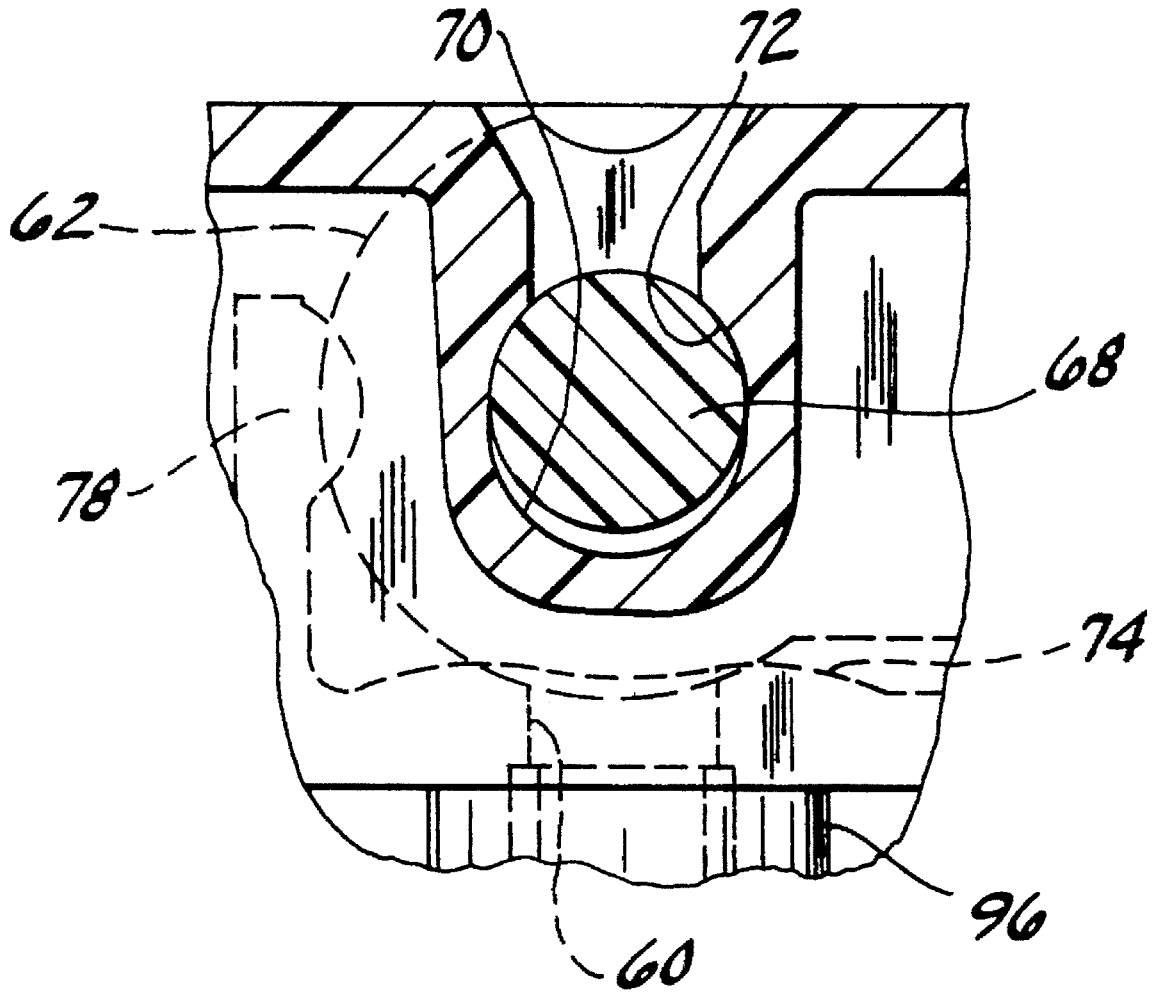
FIG. 11 is a sectional view taken along the plane of line 11—11 of FIG. 9.

Referring now to FIGS. 7–11, the container closure 24 comprises a generally cylindric screw cap 50 adapted for securement to a mouth 52 (see FIG. 8) of the container 22, and a spout 54 on the cap. The cap 50 has a top 56, an annular skirt 58 circumscribing the top, and a cap opening 60 through the top for passage therethrough of liquid in the container 22. The spout 54 has a generally cylindric base 62, a nozzle 64 extending outwardly from the base 62, a flow passage 66 through the nozzle 64 and base, and a pair of trunnions 68 extending laterally from the base. The trunnions 68 have a snap fit in generally cylindric recesses 70 formed in the cap top 56 and are retained therein by bearing surfaces 72 forming the walls of the recesses 70. Preferably, the spout 54 and cap 50 are formed of a generally resilient polymeric resinous material, so that the bearing surfaces 72 and trunnions 68 temporarily deform to enable insertion of the trunnions into the recesses 70. With the trunnions 68 within the recesses 70, the bearing surfaces 72 push down against the trunnions to urge the cylindrical base 62 of the spout 54 into sealing contact with a raised annular seat 74 around the cap opening 60 (the seat preferably being formed as an integral part of the top 56 of the cap). The spout 54 is pivotably moveable relative to the cap 50 between open and closed positions. In its open position (FIGS. 7 and 8) the spout flow passage 66 is in registration with the cap opening 60 for passage of liquid through the cap opening and spout flow passage. In its closed position (FIG. 10) the spout flow passage 66 is out of registration with the cap opening 60 and a portion of the cylindric base 62 is in sealing contact with the seat 74 and covers the opening 60 to seal against passage of liquid through the opening. The spout flow passage 66 has inlet and outlet ends designated 76 and 77, respectively (FIG. 10).

The cap 50 is constructed to have a generally resilient flap 78 extending up from the cap top 56. This flap carries a protrusion 80 adapted to plug the inlet 76 of the spout flow passage (as shown in FIG. 10) when the spout 54 is in its closed position. Preferably, the flap 78 is oriented to urge the protrusion 80 into the spout flow passage inlet 76 when the spout 54 is in its closed position. As the spout 54 is moved from its open position to its closed position (or vice versa), the cylindric base 62 of the spout engages the flap protrusion 80 and pushes the flap 78 to the left as viewed in FIGS. 7 and 10. The spout 54 has an indentation 82 on its cylindric base 62 to receive the flap protrusion 80 when the spout 54 is in its open position thereby to relieve stress on the flap 78. The cap top 56 has a vent hole 84 for equalizing pressure within the container 22 during dispensing of liquid from the container. A vent plug 86 on the spout nozzle 64 closes the vent hole 84 and prevents leakage therefrom when the spout 54 is in its closed position.

As best illustrated in FIG. 9, the spout 54 has two generally planar surfaces 88 at opposite ends of the cylindric base 62, each such end surface 88 having a shallow indentation 90 formed therein. The cap top 56 has two generally vertical walls 92, each opposing one of the side surfaces 88 and having a protrusion 94 receivable within the indentation 90 in a respective surface. The protrusion 94 mates with the indentation 90 when the spout 54 is in its open position to releasably retain the spout in its open position.

The top 56 of the cap 50 is formed with a socket 96 extending down from the cap opening 60 for holding the upper end of a substantially rigid dip tube 98. The dip tube extends down into the container 22 for conveying liquid in the container to the cap opening 60 and through the spout flow passage 66 when the spout is in its open position. Preferably, the lower end of the rigid dip tube 98 is adjacent the bottom of the container 22 (FIG. 1) so that essentially the entire contents of the container may be conveyed through the dip tube. A connector, generally designated 100, is provided for connecting the tubing 28 to the nozzle 64 of the spout 54 so that the inlet end 36 of the tubing is in communication with the outlet end 77 of the spout flow passage 66.

The connector 100 comprises a body 102 secured to the inlet end 36 of the tubing 28, a generally rigid nipple 104 extending from the body for insertion into the outlet end 77 of the spout flow passage 66, and a connector flow passage 106 through the body and nipple. The connector flow passage 106 is adapted for sealingly receiving the inlet end 36 of the tubing 28. The nipple 104 and spout flow passage 66 are sized and shaped for a snug sealing fit of the nipple within the spout flow passage. The nipple 104 includes an annular flange 108 and the spout 54 includes an internal annular groove 110 sized and shaped for a resilient snap fit of the annular flange in the groove when the nipple is inserted into the spout flow passage 66. The annular groove 110 defines an annular shoulder 112 engageable with the annular flange 108 for resisting removal of the nipple 104 from the spout 54. Preferably, the body 102 is configured to form a finger grip 114 having a shape for facilitating gripping of the connector 100 during insertion of the nipple 104 into the spout flow passage 66. As shown in the drawings, the body 102 is configured to have a series of spaced annular elements thereon, but it will be understood that other configurations suitable for providing a good grip can also be used without departing from the scope of this invention.

An annular retainer 116 on the body 102 secures the inlet end 36 of the tubing 28 in the connector flow passage 106. The retainer 116 has a plurality of spring fingers (not shown) which are resiliently flexible for permitting insertion of the inlet end 36 of the tubing 28 into the connector flow passage 106 and for thereafter gripping the tubing 28 to resist removal of the tubing from the connector flow passage. A retainer suitable for use is commercially available from A F A Products, Inc., Forest City, N.C.

The dispensing system 20 is preferably provided to a user with the sprayer 26 attached to the container 22 within the container recess 42 and with the entire length of tubing 28 and connector 100 contained within the hollow handle 32 of the sprayer. In use, the sprayer 26 is detached from the container 22, and the inlet end 36 and intermediate portion 38 of the tubing 28 and the connector 100 are removed from the handle 32. The nipple of the connector 100 is then inserted into the outlet end of the spout flow passage 66 so that the tubing 28 communicates with the spout flow passage. The spout 54 is pivoted to its open position so that the dip tube 98 communicates with the tubing 28, the cap opening 60 and the spout flow passage 66. With the spout thus positioned, the trigger 34 may be manually squeezed to draw liquid in the container 22 out of the container through the dip tube 98, spout flow passage 66, connector flow passage 106, and tubing 28, for dispensing from the spray head 30. The flexibility of tubing 28 permits the sprayer to be moved in any direction relative to the container. After the user finishes spraying, the spout 54 is pivoted to its closed position where: (1) the flap 78 urges the flap protrusion 80 into the inlet 76 of the spout flow passage 66 to prevent liquid in the tubing 28 from flowing back through the spout 54; (2) the cap opening 60 is out of registration with the spout flow passage 66 and is covered by the cylindrical base 62 to seal against passage of liquid through the cap opening 60; and (3) the vent plug 86 plugs the vent hole 84 to prevent leakage of liquid through the vent hole. Thus, when the spout 54 is in its closed position, liquid is prevented from leaking from the dispensing system 20. The sprayer 26 may then be inserted back into the recess 40 and reattached to the container 22. With the sprayer 26 stored within the recess 42, the spray head 30 is positioned near the top of the container 22, thus minimizing the risk of liquid leaking or draining from the system after use and during storage. If the dispensing system 20 is to be stored for an extended period, the connector 100 may be detached from the spout 54 and the tubing 28 and connector reinserted into the hollow handle 32.

In view of the above, it will be seen that the several objects of the invention are achieved and other advantageous results attained.

As various changes could be made in the above construction without departing from the scope of the invention, it is intended that all matter contained in the above description or shown in the accompanying drawings shall be interpreted as illustrative and not in a limiting sense.

What is claimed is:

1. A dispensing system comprising a container for containing a liquid to be dispensed, said container having a top and opposing side walls, a sprayer comprising a spray head and a handle connected to the spray head, flexible tubing having an inlet end adapted to communicate with the interior of the container and an outlet end connectable to the sprayer for conveying liquid from the container to the sprayer, a recess in one of said opposing side walls of the container sized and shaped for receiving the handle of the sprayer, and means for attaching the sprayer to the container with the sprayer in said recess in a position wherein the spray head of the sprayer is generally adjacent the top of the container to minimize leakage of liquid from the container through the sprayer, the sprayer being detachable from the container for dispensing liquid from the container.

2. A dispensing system as set forth in claim 1 wherein said sprayer is a manually operable pump sprayer with a trigger actuator, said recess being sized and shaped for receiving the entire sprayer, including the trigger actuator.

3. A dispensing system as set forth in claim 1 wherein said container has a handle defining a handle opening; wherein, as viewed from said one side of the container, the container has an outline and the handle opening has an outline; and wherein the container, recess, sprayer and handle opening are so sized and located relative to one another that when the sprayer is positioned in the recess, the sprayer is located entirely within said container outline and entirely outside the outline of the handle opening.

4. A dispensing system as set forth in claim 1 wherein said attaching means comprises means for releasably attaching the sprayer to the container, said sprayer being reattachable to the container within said recess for storage of the dispensing system.

5. A dispensing system as set forth in claim 1 wherein said attaching means comprises mateable male and female connectors, said male connector being on one of the sprayer and container and the female connector being on the other of the sprayer and container.

6. A dispensing system as set forth in claim 5 wherein said connectors are formed as integral respective parts of the sprayer and container.

7. A dispensing system as set forth in claim 5 wherein said male connector is formed as an integral part of the container and said female connector is formed as an integral part of the sprayer.

8. A dispensing system as set forth in claim 1 wherein said tubing has an inlet end adapted for connection to the container and an outlet end operatively connected to the sprayer, said dispensing system further comprising:

a connector having a body secured to the inlet end of the tubing, a generally rigid nipple extending from the body, and a connector flow passage through said body and nipple and in communication with the inlet end of the tubing; and a closure comprising a cap adapted for securement to the container and having a cap opening therein for passage therethrough of liquid in the container, and a spout on the cap having a flow passage therethrough adapted for sealingly receiving the nipple of the connector thereby to connect the inlet end of the tubing to the closure of the container.

9. A dispensing system as set forth in claim 8 wherein said spout flow passage and nipple are sized and shaped for a snug sealing fit of the nipple within the spout flow passage.

10. A dispensing system as set forth in claim 8 wherein the connector flow passage is adapted for sealingly receiving the inlet end of the tubing, and wherein the connector further comprises a retainer on said body for securing the inlet end of the tubing in the connector flow passage.

11. A dispensing system as set forth in claim 8 wherein said body is configured to form a finger grip having a shape for facilitating gripping of the connector during insertion of the nipple into the spout flow passage.

12. A dispensing system as set forth in claim 8 wherein said connector further comprises an annular flange around the nipple, and wherein said spout has an annular groove sized and shaped for a resilient snap fit of the annular flange in the groove when the nipple is inserted into the spout flow passage, said annular groove defining an annular shoulder engageable with the annular flange for resisting removal of the nipple from the spout.

13. A dispensing system as set forth in claim 8 wherein said spout is mounted on the cap for pivotable movement of the spout relative to the cap between an open position in which said spout flow passage is in registration with said cap opening for passage of liquid in the container out of the container and thence through the connector and tubing to the sprayer, and a closed position in which said spout flow passage is out of registration with said cap opening and a sealing portion of the spout covers the opening to seal against passage of liquid through the opening.

14. A dispensing system as set forth in claim 13 further comprising a generally rigid dip tube connected to the cap adjacent said cap opening and adapted to extend down into the container for conveying liquid in the container to the opening.

15. A dispensing system as set forth in claim 13 wherein said spout has an inlet end defining an inlet of the spout flow passage, and wherein said closure further comprises a sealing member engageable with the spout inlet end when the spout is pivoted to its closed position for sealing the spout flow passage inlet.

16. A dispensing system as set forth in claim 15 wherein said sealing member comprises a generally resilient flap extending up from the cap, said flap engaging the spout inlet end and covering the spout flow passage inlet when the spout is pivoted to its closed position.

17. A dispensing system as set forth in claim 15 wherein said sealing member comprises a generally resilient flap extending from the cap, and a protrusion on the flap adapted to plug the inlet of the spout flow passage when the spout is in its closed position.

18. A dispensing system as set forth in claim 17 wherein said resilient flap urges the protrusion into the spout flow passage inlet when the spout is in its closed position.

19. A dispensing system as set forth in claim 18 wherein said protrusion is receivable in an indentation in the spout when the spout is in its open position.

20. A dispensing system comprising a container for containing a liquid to be dispensed, a sprayer, and flexible tubing for conveying liquid from the container to the sprayer, said sprayer having an actuator movably operable to dispense liquid from the sprayer, said container having a recess formed thereon sized and shaped for receiving the sprayer, and means for attaching the sprayer to the container with the sprayer received within the recess, said sprayer being detachable from the container for dispensing liquid from the container, said sprayer further comprising a spray head and a hollow handle connected to the spray head, the actuator being adjacent the handle, said tubing having an inlet end adapted for connection to the container, an outlet end operatively connected to the spray head of the sprayer, and an intermediate portion between its inlet and outlet ends, said hollow handle of the sprayer being sized and shaped to receive said inlet end and intermediate portion of the flexible tubing for storage thereof in the handle when the inlet end is not connected to the container, said inlet end and intermediate portion being removable from the handle to permit operative connection of the inlet end to the container.

21. A dispensing system as set forth in claim 20 further comprising a closure for the container, said closure comprising a cap adapted for securement to the container and having a cap opening therein for passage therethrough of liquid in the container, and a spout on the cap having a flow passage therethrough, the inlet end of said tubing being adapted for connection to the spout with the inlet end in communication with the passage, said spout being mounted on the cap for pivotable movement of the spout relative to the cap between an open position in which said spout flow passage is in registration with said cap opening for passage of liquid in the container out of the container and thence through the tubing to the sprayer, and a closed position in which said spout flow passage is out of registration with said cap opening and a sealing portion of the spout covers the opening to seal against passage of liquid through the opening.

22. A dispensing system for dispensing a liquid from a container, said dispensing system comprising a sprayer and flexible tubing for conveying liquid in the container to the sprayer, said sprayer having a spray head, a hollow handle connected to the spray head, and an actuator adjacent the handle movably operable to dispense liquid from the spray head, said tubing having an inlet end adapted for connection to the container, an outlet end operatively connected to the spray head, and an intermediate portion between the inlet and outlet ends, said hollow handle being sized and shaped to receive said inlet end and intermediate portion of the tubing for storage thereof in the handle when the inlet end is not connected to the container, said inlet end and intermediate portion of the tubing being removable from the handle to permit operative connection of the inlet end to the container.

23. A dispensing system as set forth in claim 22 wherein said flexible tubing is a coiled line.

24. A dispensing system as set forth in claim 22 further comprising:

a connector having a body secured to the inlet end of the tubing, and a generally rigid nipple extending from the body, said nipple having a flow passage in communication with the inlet end of the tubing; and a closure comprising a cap adapted for securement to the container and having a cap opening therein for passage therethrough of liquid in the container, and a spout on the cap having a flow passage therethrough adapted for sealingly receiving the nipple of the connector thereby to connect the inlet end of the tubing to the closure of the container.

25. A dispensing system as set forth in claim 24 wherein said spout flow passage and nipple are sized and shaped for a snug sealing fit of the nipple within the spout flow passage.

26. A dispensing system as set forth in claim 24 wherein said connector further comprises an annular flange around the nipple, and wherein said spout has an annular groove sized and shaped for a resilient snap fit of the annular flange in the groove when the nipple is inserted into the spout flow passage, said annular groove defining an annular shoulder engageable with the annular flange for resisting removal of the nipple from the spout.

27. A dispensing system as set forth in claim 24 wherein said spout and cap are separate pieces.

28. A dispensing system as set forth in claim 27 wherein said spout is mounted on the cap for pivotable movement of the spout relative to the cap between an open position in which said spout flow passage is in registration with said cap opening for passage of liquid in the container out of the container and thence through the connector and tubing to the sprayer, and a closed position in which said spout flow passage is out of registration with said cap opening and a sealing portion of the spout covers the opening to seal against passage of liquid through the opening.

29. A dispensing system as set forth in claim 28 further comprising a generally rigid dip tube connected to the cap adjacent said cap opening and adapted to extend down into the container for conveying liquid in the container to the opening.

30. A dispensing system comprising:

a container for containing a liquid to be dispensed;

a closure comprising a cap and a spout mounted on the cap, said cap being adapted for securement to said container and having a cap opening therein for passage therethrough of liquid in the container, said spout having a flow passage therethrough;

a generally rigid dip tube connected to the cap adjacent said opening and adapted to extend down into the container for conveying liquid in the container to the opening;

a sprayer; and a tubing for conveying liquid from the spout to the sprayer, said tubing having an inlet end adapted for connection to the spout with the inlet end in communication with said passage in the spout, and an outlet end connected to the sprayer;

said spout being mounted on the cap for pivotable movement of the spout relative to the cap between an open position in which said spout flow passage is in registration with said cap opening for passage of liquid in the container out of the container through the dip tube, tubing and sprayer, and a closed position in which said spout flow passage is out of registration with said cap opening and a sealing portion of the spout covers the opening to seal against passage of liquid through the opening.

31. A dispensing system for dispensing a liquid from a container, said dispensing system comprising:

a closure comprising a cap and a spout mounted on the cap, said cap being adapted for securement to said container and having a cap opening therein for passage therethrough of liquid in the container, said spout having a flow passage therethrough;

a dispensing device comprising a manually operable pump sprayer detachable from the container; and flexible tubing for conveying liquid from the spout to the sprayer, said tubing having an inlet end adapted for connection to the spout with the inlet end in communication with said passage in the spout and an outlet end connected to the sprayer, the flexibility of the tubing permitting movement of the sprayer in any direction relative to the container when the sprayer is detached from the container;

said spout being mounted on the cap for pivotable movement of the spout relative to the cap between an open position in which said spout flow passage is in registration with said cap opening for passage of liquid in the container out of the container and thence through the tubing to the sprayer, and a closed position in which said spout flow passage is out of registration with said cap opening and a sealing portion of the spout covers the opening to seal against passage of liquid through the opening.

32. A dispensing system as set forth in claim 31 wherein said cap is a screw cap removable from the container.

33. A dispensing system as set forth in claim 31 further comprising a generally rigid dip tube connected to the cap adjacent said cap opening and adapted to extend down into the container for conveying liquid in the container to the opening.

34. A dispensing system for dispensing a liquid from a container, said dispensing system comprising:

a closure comprising a cap and a spout mounted on the cap, said cap being adapted for securement to said container and having a cap opening therein for passage therethrough of liquid in the container, said spout having a flow passage therethrough;

a dispensing device; and tubing for conveying liquid from the spout to the dispensing device, said tubing having an inlet end adapted for connection to the spout with the inlet end in communication with said passage in the spout and an outlet end connected to the dispensing device;

said spout being mounted on the cap for pivotable movement of the spout relative to the cap between an open position in which an inlet of the spout flow passage is in registration with said cap opening for passage of liquid in the container out of the container and thence through the tubing to the dispensing device, and a closed position in which the inlet of the spout flow passage is out of registration with said cap opening and a sealing portion of the spout covers the cap opening to seal against passage of liquid through the cap opening;

said closure further comprising a sealing member engageable with the spout when the spout is pivoted to its closed position for sealing the inlet of the spout flow passage, said sealing member comprising a generally resilient flap extending up from the cap, said flap engaging the spout and covering the inlet of the spout flow passage when the spout is pivoted to its closed position.

35. A dispensing system as set forth in claim 34 wherein said sealing member further comprises a protrusion on the flap adapted to plug the inlet of the spout flow passage when the spout is in its closed position.

36. A dispensing system as set forth in claim 35 wherein said resilient flap urges the protrusion into the spout flow passage inlet when the spout is in its closed position.

37. A dispensing system as set forth in claim 36 wherein said protrusion is receivable in an indentation in the spout when the spout is in its open position.

38. A dispensing system for dispensing a liquid from a container, said dispensing system comprising:

a closure comprising a cap and a spout mounted on the cap, said cap being adapted for securement to said container and having a cap opening therein for passage therethrough of liquid in the container, said spout having a flow passage therethrough;

a dispensing device;

tubing for conveying liquid from the spout to the dispensing device, said tubing having an inlet end adapted for connection to the spout with the inlet end in communication with said passage in the spout and an outlet end connected to the dispensing device;

said spout being mounted on the cap for pivotable movement of the spout relative to the cap between an open position in which said spout flow passage is in registration with said cap opening for passage of liquid in the container out of the container and thence through the tubing to the dispensing device, and a closed position in which said spout flow passage is out of registration with said cap opening and a sealing portion of the spout covers the opening to seal against passage of liquid through the opening; and a connector for connecting the inlet end of the tubing to the closure of the container, said connector having a body secured to the inlet end of the tubing, a generally rigid nipple extending from the body, and a connector flow passage through said body and nipple and in communication with the inlet end of the tubing, said flow passage of the spout being adapted for sealingly receiving the nipple.

39. A dispensing system as set forth in claim 38 wherein said spout flow passage and nipple are sized and shaped for a snug sealing fit of the nipple within the spout flow passage.

40. A dispensing system as set forth in claim 38 wherein the connector flow passage is adapted for sealingly receiving the inlet end of the tubing, and wherein the connector further comprises a retainer on said body for securing the inlet end of the tubing in the connector flow passage.

41. A dispensing system as set forth in claim 38 wherein said body is configured to form a finger grip having a shape for facilitating gripping of the connector during insertion of the nipple into the spout flow passage.

42. A dispensing system as set forth in claim 38 wherein said connector further comprises an annular flange around the nipple, and wherein said spout has an annular groove sized and shaped for a resilient snap fit of the annular flange in the groove when the nipple is inserted into the spout flow passage, said annular groove defining an annular shoulder engageable with the annular flange for resisting removal of the nipple from the spout.

43. A dispensing system comprising a container for containing a liquid to be dispensed, said container having opposing side walls and a handle defining a handle opening, a sprayer comprising a spray head and a handle connected to the spray head, flexible tubing having an inlet end adapted to communicate with the interior of the container and an outlet end connectable to the sprayer for conveying liquid from the container to the sprayer, a recess in one of said opposing side walls of the container sized and shaped for receiving the handle of the sprayer, and means for releasably attaching the sprayer to the container with the sprayer in said recess, the container as viewed from its said one side having an outline and the handle opening having an outline, the container, recess, sprayer and handle opening being so sized and located relative to one another that when the sprayer is positioned in the recess, the sprayer is located entirely within said container outline and entirely outside the outline of the handle opening.

* * * * *